US010214306B2

(12) United States Patent
Slurink et al.

(10) Patent No.: US 10,214,306 B2
(45) Date of Patent: Feb. 26, 2019

(54) FILLING STATION FOR FILLING CONTAINERS WITH A LIQUID

(71) Applicant: Sluis Cigar Machinery B.V., Kampen (NL)

(72) Inventors: Oscar Slurink, Heino (NL); Lambert Wijnand Breman, Kampen (NL)

(73) Assignee: Sluis Cigar Machinery B.V., Kampen (NL)

( * ) Notice: Subject to any disclaimer, the term of this patent is extended or adjusted under 35 U.S.C. 154(b) by 0 days.

(21) Appl. No.: 15/310,818

(22) PCT Filed: May 12, 2015

(86) PCT No.: PCT/NL2015/050338

§ 371 (c)(1),
(2) Date: Nov. 14, 2016

(87) PCT Pub. No.: WO2015/174837

PCT Pub. Date: Nov. 19, 2015

(65) Prior Publication Data

US 2017/0217615 A1 Aug. 3, 2017

(30) Foreign Application Priority Data

May 16, 2014 (NL) ..... 2012833

(51) Int. Cl.
*B65B 39/12* (2006.01)
*B65B 39/14* (2006.01)
(Continued)

(52) U.S. Cl.
CPC ..... *B65B 39/12* (2013.01); *B65B 39/145* (2013.01); *B67C 3/04* (2013.01); *B67C 3/225* (2013.01); *B67C 3/26* (2013.01); *B67C 3/28* (2013.01)

(58) Field of Classification Search
CPC ..... B65B 39/12; B65B 39/14; B65B 39/145; B67C 3/26; B67C 3/28; B67C 3/04; B67C 3/225
(Continued)

(56) References Cited

U.S. PATENT DOCUMENTS 2,839,094 A * 6/1958 Reno ..... B67C 3/04 141/140
3,037,536 A * 6/1962 Fechheimer ..... B65B 3/26 141/116
(Continued)

OTHER PUBLICATIONS

Third Party Observation for Application No. EP 15729257.4, dated Mar. 1, 2018, 4 pages.
(Continued)

*Primary Examiner* — Nicolas A Arnett
(74) *Attorney, Agent, or Firm* — Hoffmann & Baron, LLP

(57) ABSTRACT

A filling station for filling containers includes a number of container holders defining respective container positions; a number of filling assemblies, each filling assembly being associated with a container holder, where each filling assembly includes a reciprocating nozzle assembly which makes a first reciprocating movement from a retracted nozzle position in which a nozzle is retracted from the container to an inserted nozzle position in which the nozzle is inserted into the container, where the nozzle moves through an opening in a lid member of a reciprocating lid assembly to be inserted into the container for filling the container with liquid; where the reciprocating lid assembly makes a second reciprocating movement towards a filling opening of the container in the container holder and back in a direction away from the filling opening, where the reciprocating lid assembly is under pretension in the direction of the container holder.

20 Claims, 7 Drawing Sheets

(51) Int. Cl.

| | |
|---|---|
| ***B67C 3/26*** | (2006.01) |
| ***B67C 3/04*** | (2006.01) |
| ***B67C 3/22*** | (2006.01) |
| ***B67C 3/28*** | (2006.01) |

(58) Field of Classification Search
USPC ..... 141/140
See application file for complete search history.

(56) References Cited

U.S. PATENT DOCUMENTS 3,150,697 A * 9/1964 Risser ..... B65B 39/145 141/140
3,176,731 A 4/1965 Minard
3,335,767 A * 8/1967 Manas ..... B65B 3/323 141/147
3,354,614 A * 11/1967 St Clair ..... B65B 43/50 141/140
3,461,923 A * 8/1969 Riesenberg ..... B67C 3/04 141/140
3,516,455 A * 6/1970 Carter ..... B67C 3/06 141/119
3,580,298 A * 5/1971 Trusselle ..... B67C 3/04 141/140
3,605,827 A * 9/1971 Risser ..... B67C 3/22 141/141
3,720,242 A * 3/1973 Friendship ..... B65D 83/14 141/6
3,837,378 A 9/1974 Kanki et al.
3,841,363 A * 10/1974 Stigler ..... B65B 3/323 141/142
3,905,404 A * 9/1975 Cox ..... B65B 57/06 137/803
4,375,826 A * 3/1983 Stohlquist ..... B65B 39/004 141/137
4,787,428 A * 11/1988 Bacroix ..... B67C 3/26 137/113
5,417,260 A * 5/1995 Perrier ..... B67C 3/206 141/140
7,350,546 B2 * 4/2008 Stavrakis ..... B67C 3/26 141/386
7,661,449 B2 * 2/2010 Stavrakis ..... B67C 3/26 141/302
7,921,886 B2 * 4/2011 Stavrakis ..... B67C 3/28 141/302
8,312,901 B2 11/2012 Goldbrunner
8,505,594 B2 8/2013 Krulitsch
2017/0217607 A1 * 8/2017 Slurink ..... B65B 3/12

OTHER PUBLICATIONS

Third Party Observation for Application No. EP 15729257.4, dated Mar. 13, 2018, 3 pages.

* cited by examiner

FILLING STATION FOR FILLING CONTAINERS WITH A LIQUID

CROSS-REFERENCE TO RELATED APPLICATIONS

This application is the National Stage of International Application No. PCT/NL2015/050338 filed May 12, 2015, which claims the benefit of Netherlands Application No. NL 2012833, filed May 16, 2014, the contents of which is incorporated by reference herein.

FIELD OF THE INVENTION

The present invention relates to a filling station for filling containers with a liquid. The present invention further relates to a method for filling containers with a liquid. The method and device are in particular suitable for filling liquid containers of e-cigarettes.

BACKGROUND OF THE INVENTION

When containers need to be filled with a liquid in an assembly line, the process needs to be effective and reliable.

Further, a nozzle with which the container is filled sometimes needs to be inserted into the container during the filling. If the container is filled with non-wovens or a similar material, the non-wovens may stick to the nozzle and be pulled out from the container once the nozzle is retracted.

OBJECT OF THE INVENTION

It is an object of the present invention to provide an effective and reliable filling station, in which for each container which is filled the nozzle is inserted into the container prior to filling and retracted from the container after filling of the container.

It is an object of the present invention to provide a filling station in which a filling opening of a container which is to be filled is effectively closed at least partially during filling.

It is an object of the present invention to provide a filling station for filling containers with non-wovens or similar material in which a filling opening of a container which is to be filled is effectively closed at least partially during filling.

It is a further object of the present invention to provide a filling station which is a suitable variant to known filling stations.

It is a further object of the present invention to provide a filling station wherein a number of mechanical parts can function for a relatively long time before replacement.

SUMMARY OF THE INVENTION

In order to achieve at least one of the mentioned objects, the present invention relates to a filling station for filling containers with a liquid, the filling station comprising:

- a number of container holders which define respective container positions,
- a number of filling assemblies, wherein each filling assembly is associated with a container holder, wherein each filling assembly comprises:
  - a reciprocating nozzle assembly which is constructed to make a first reciprocating movement relative to the associated container holder from a retracted nozzle position in which a nozzle is retracted from the container to an inserted nozzle position in which the nozzle is inserted into the container, wherein the nozzle moves through an opening in a lid member of a reciprocating lid assembly to be inserted into the container for filling the container with a liquid,
  - the reciprocating lid assembly comprising the lid member, wherein the reciprocating lid assembly is configured to make a second reciprocating movement relative to the associated container holder in a direction towards a filling opening of the container which is positioned in the container holder and back in a direction away from the filling opening of the container, wherein the reciprocating lid assembly is under pre-tension in the direction of the container holder, and wherein the lid member is urged by the pre-tension from a retracted lid position to an extended position beyond the filling opening, wherein in case a container is present in the container holder the lid member engages the filling opening in a closed lid position which lies between the retracted lid position and the extended lid position, thereby at least partially closing the filling opening during filling, and wherein in case there is no container present in the container holder the lid member is urged to the extended position, wherein the reciprocating lid assembly is coupled via a valve coupling to an associated valve in a feed channel which opens the feed channel in the closed lid position and closes the feed channel in the extended position.

The present invention was found to be effective and reliable.

In an embodiment, during the movement toward the filling opening the reciprocating lid assembly and the reciprocating nozzle assembly first move jointly until the lid member of the reciprocating lid assembly engages the filling opening in the closed lid position, and wherein from this moment onward, the reciprocating lid assembly is stationary relative to the filling opening while the reciprocating nozzle assembly continues to move, thereby inserting the nozzle into the container, and wherein after the filling of the container the reciprocating nozzle assembly is retracted to an engagement position, wherein in the engagement position a stop member of the reciprocating nozzle assembly engages a stop member of the reciprocating lid assembly, and wherein from this point onward the reciprocating lid assembly is retracted by the reciprocating nozzle assembly against the biasing action via the engaging stop members.

In an embodiment, the biasing action is caused by a spring.

In an embodiment, the reciprocating nozzle assembly is driven by a cam in a cam track.

In an embodiment, the reciprocating lid assembly is not driven by a cam directly, but only by the biasing action, in particular of the spring, and by the reciprocating nozzle assembly.

In an embodiment, the reciprocating nozzle assembly and a biasing device jointly operate the second reciprocating movement of the reciprocating lid assembly.

In an embodiment, in the retracted position the reciprocating nozzle assembly holds the reciprocating lid assembly against the biasing action.

In an embodiment, the lid member of the reciprocating lid assembly is initially moved to the closed lid position, and wherein subsequently the nozzle is inserted into the container to the inserted nozzle position, wherein subsequently filling takes place, and wherein subsequently the nozzle is retracted from the container and wherein subsequently the reciprocating lid assembly is moved away from the container, thereby disengaging the lid member from the filing opening.

In an embodiment, the valve coupling between the reciprocating lid assembly and the valve comprises a valve cam which reciprocates with the reciprocating lid assembly, wherein the valve cam engages an operating member of the valve.

In an embodiment, the lid member comprises multiple openings and multiple nozzles which move through said openings.

In an embodiment, the nozzle is retracted inside a tube of the reciprocating lid assembly.

In an embodiment, the spring extends around said tube.

In an embodiment, the multiple container holders and associated filling assemblies are mounted on a rotary frame to form a carousel which makes a rotary movement, wherein the multiple container holders are arranged in a circle for rotary movement, and wherein the multiple filling assemblies are also arranged in a circle, and wherein the filling station comprises a nozzle assembly cam track, and wherein each reciprocating nozzle assembly comprises a nozzle assembly cam which runs through the nozzle assembly cam track, and wherein the nozzle assembly cam track comprises a cam track closing section which is configured to allow the spring to move the reciprocating lid assembly to a closed lid position, and wherein the cam track comprises a retracting section configured to retract the lid member from the filling opening of the container.

In an embodiment, the reciprocating nozzle assembly and the reciprocating lid assembly are coaxial.

In an embodiment, the reciprocating lid assembly makes a reciprocating movement relative to the associated reciprocating nozzle assembly.

In an embodiment, the reciprocating nozzle assembly and the reciprocating lid assembly slide relative to one another.

In an embodiment, a substantial part of the reciprocating nozzle is located inside a tube of the reciprocating lid assembly.

In an embodiment, a part of the reciprocating nozzle to which a cam is connected extends to a position above the reciprocating lid assembly.

In an embodiment, the filling station comprises a filling assembly support frame which comprises a number of nozzle assembly guides which guide the associated reciprocating nozzle assembly.

In an embodiment, the nozzle comprises one or more needles which extend through the one or more openings in the lid member.

In an embodiment, the reciprocating lid assembly makes a vertical reciprocating movement, and wherein the reciprocating nozzle assembly also makes a vertical reciprocating movement.

The present invention further relates to a method of filling containers with a liquid, the method comprising providing the filling station according to the invention, and carrying out either process a) or process b), process a) comprising:

positioning a container in a container holder, moving the reciprocating nozzle assembly and the reciprocating lid assembly toward the filling opening, engaging the lid member with the filling opening of the container in the closed lid position, inserting the nozzle into the container through the lid member by a further movement of the reciprocating nozzle assembly, wherein the valve is in the filling position in which the feed channel is open, filling the container, retracting the nozzle from the container through the lid member by a retracting movement of the reciprocating nozzle assembly, disengaging the lid member from the container and retracting the lid member to a position to a distance from the filling opening, process b) comprising:

not positioning a container in a container holder, moving the reciprocating nozzle assembly and the reciprocating lid assembly toward the container holder to the extended position, engaging the container holder by the lid member, and switching the valve to close the feed channel, not ejecting any liquid from the nozzle, retracting the reciprocating nozzle assembly and the reciprocating lid assembly.

The method provides the same advantage(s) as the filling station according to the invention.

In an embodiment of the method the container comprises non-wovens or similar material for absorbing the liquid, and wherein the at least one nozzle penetrates into the non-wovens during filling of the container, and wherein the non-wovens have the tendency to stick to the nozzle during the movement of the nozzle out of the container, and wherein the lid member blocks the non-wovens from being pulled out of the container by the retracting nozzle.

These and other aspects of the invention will be more readily appreciated as the same becomes better understood by reference to the following detailed description and considered in connection with the accompanying drawings in which like reference symbols designate like parts.

DETAILED DESCRIPTION OF THE INVENTION

Figure 1:
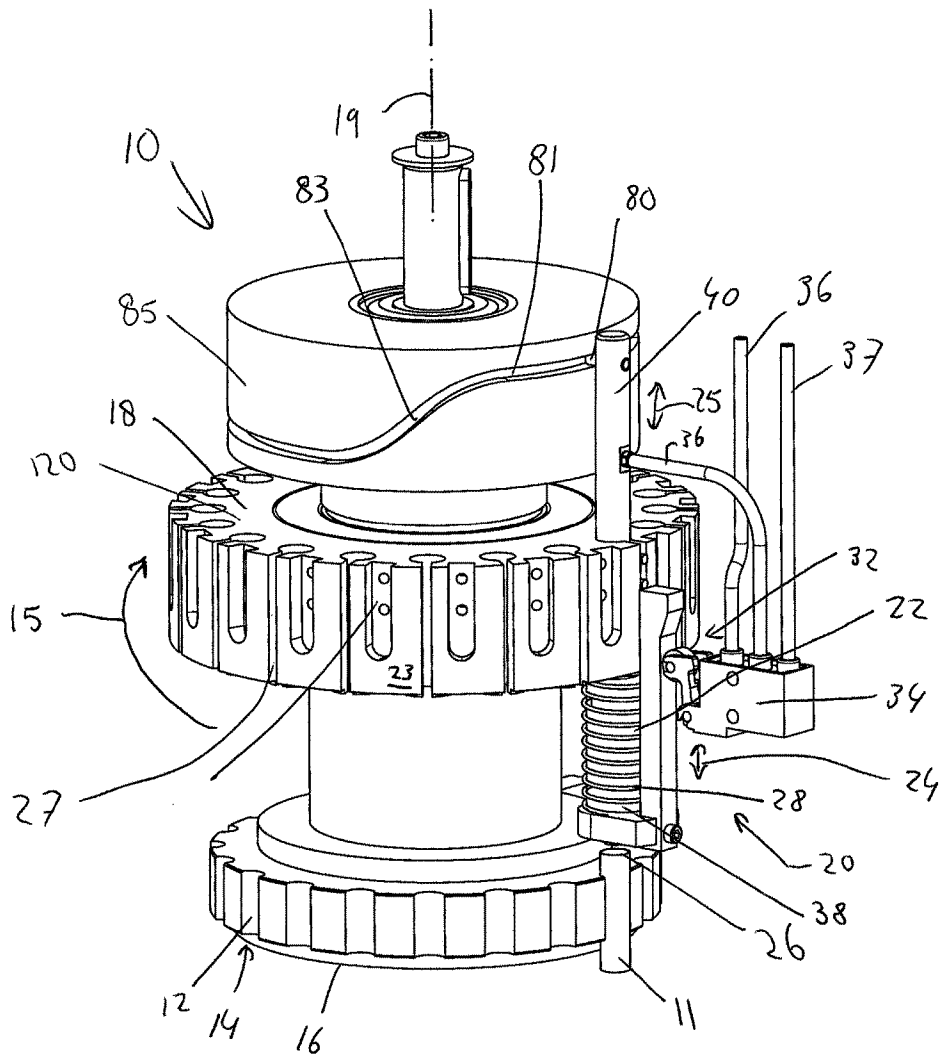
FIG. 1 shows a general isometric view of an embodiment of the invention.
Figure 2:
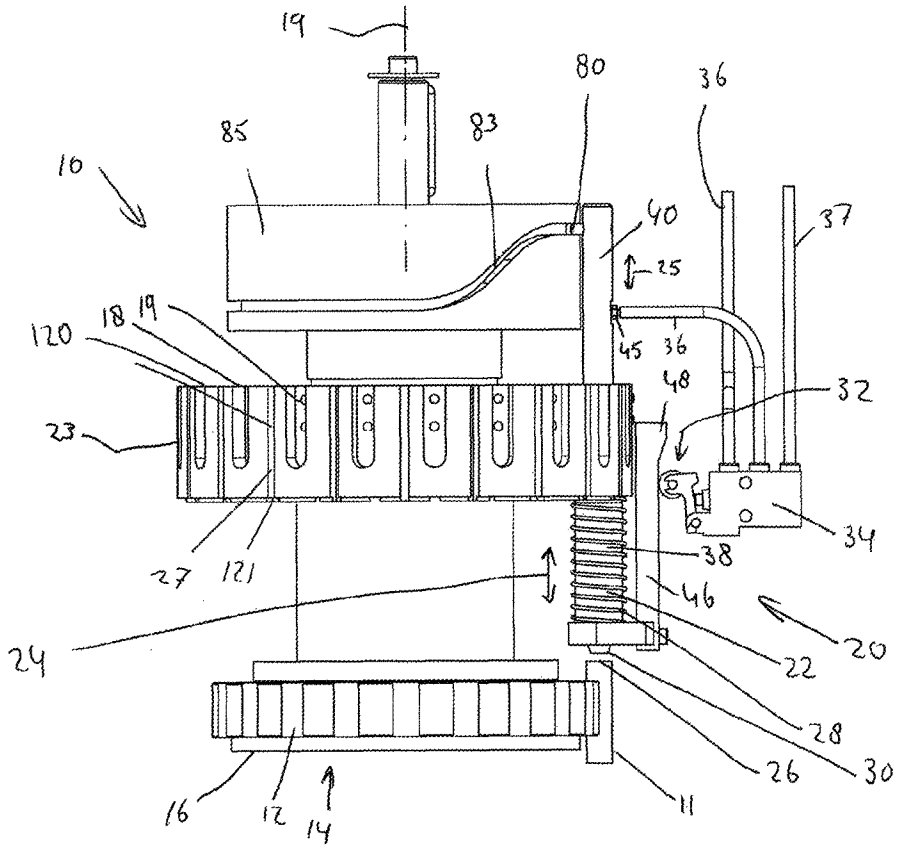
FIG. 2 shows a side view of the embodiment of FIG. 1.
Figure 3:
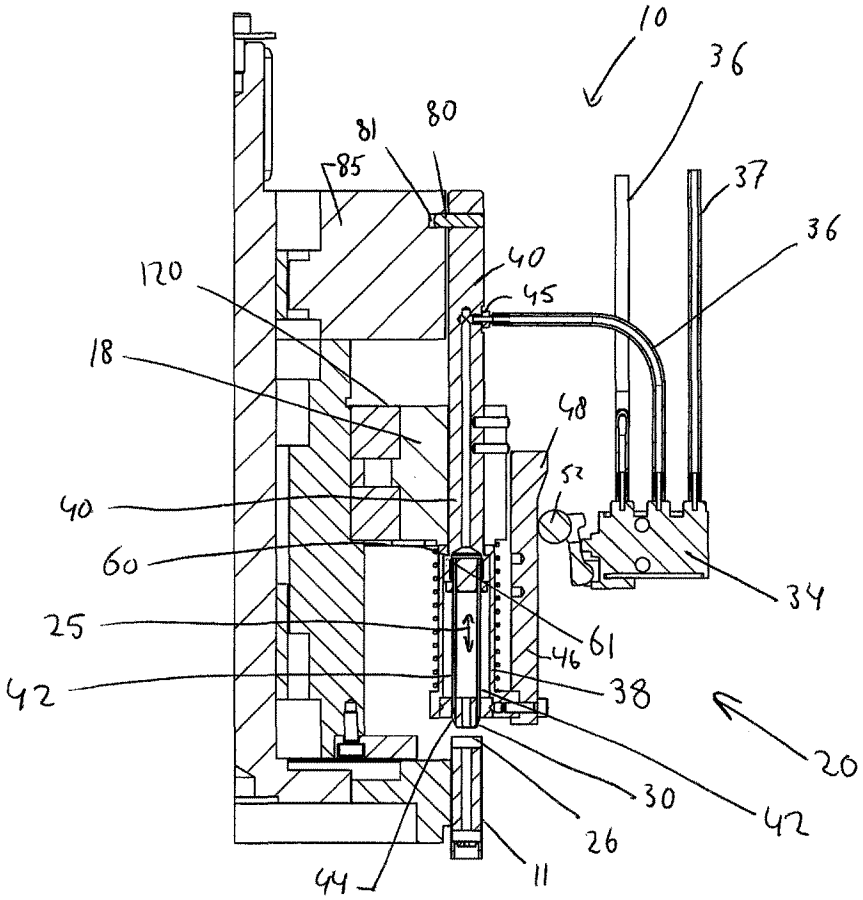
FIG. 3 shows a sectional side view of a filling assembly in a retracted position.

Turning to FIGS. 1, 2 and 3, a filling station 10 for filling containers 11 with a liquid is shown. The filling station comprises a number of container holders 12 which define respective container positions 14. Two container holders are indicated but in total twenty holders are provided. A different number is also possible. The container holders are semi-cylindrical cavities in a holder frame 16 but other types of holders are possible. The container holders are arranged in a circle for rotary movement in the direction of arrow 15.

The filling station 10 further comprises a number of filling assemblies 20. Each filling assembly is associated with a container holder 12. In this embodiment, the filling assemblies are positioned directly above the associated container holders. The filling assemblies 20 are supported by a rotary support frame 18 which rotates about a main axis 19.

The container holders 12 and the associated filling assemblies 20 are mounted on a rotary support frame to form a carousel which makes a rotary movement. Multiple container holders 12 are arranged in a circle on the holder frame 16 for rotary movement. The multiple filling assemblies 20 are also arranged in a circle.

The rotary support frame 18 comprises a number of nozzle assembly guides 21. The nozzle assembly guides are cavities in the rotary support frame and extend through the rotary support frame from the top 120 to the bottom 121 thereof. Each nozzle assembly guide further comprises an outwardly extending cavity part 27 which extends to the outer side 23 of the rotary support frame 18.

The filling assemblies 20 rotate in a synchronized manner with the container holders 12.

Each filling assembly comprises a reciprocating nozzle assembly 40 and a reciprocating lid assembly 22. The reciprocating nozzle assembly 40 is shown above the rotary support frame 18. The reciprocating nozzle assembly extends through the nozzle assembly guide 21 of the support frame 18 and comprises a cam 80. The cam runs in a cam track 81 which is defined in a cylindrical body 85 which is fixed, i.e. stationary. The cam track 81 has an inclined section 83, also indicated as closing section. When the cam 80 runs through the inclined section 83, the reciprocating nozzle assembly 40 moves downward.

Figure 4:
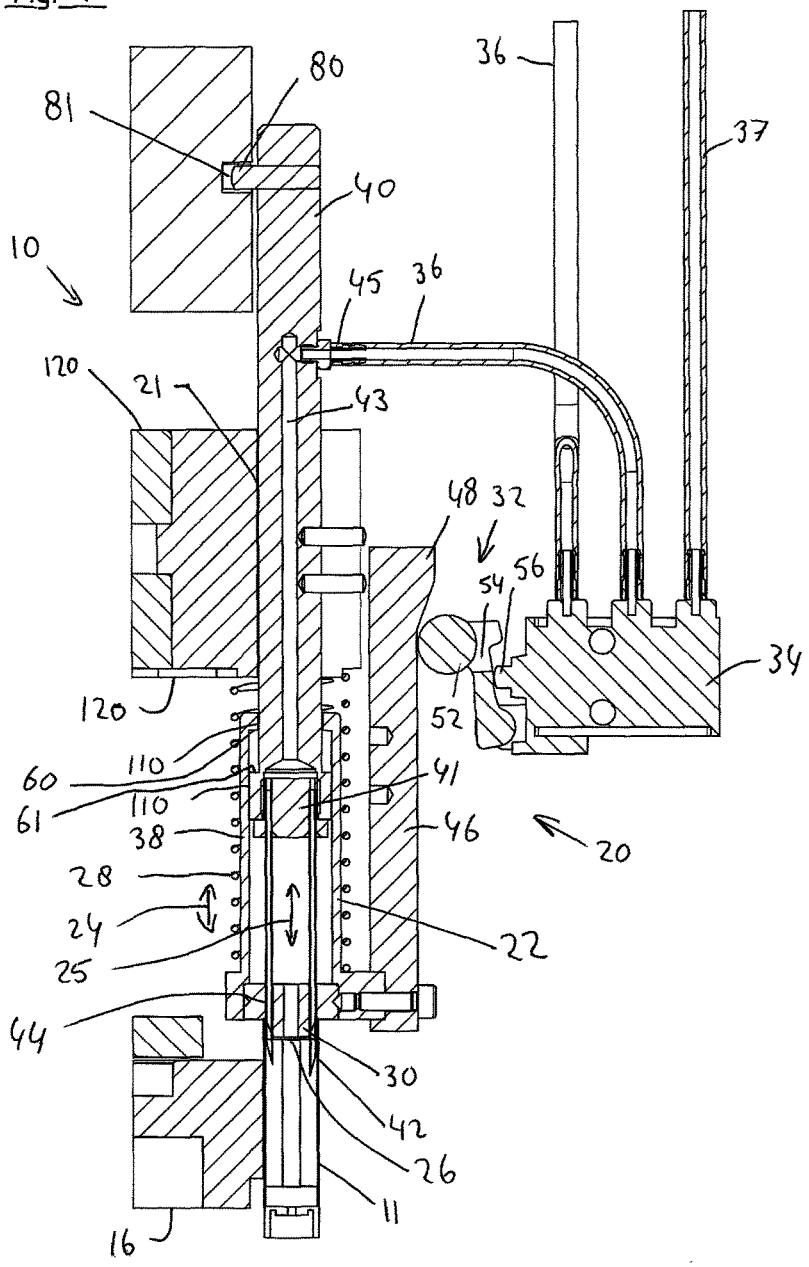
FIG. 4 shows a further sectional side view of the filling assembly in an inserted position.

Turning to FIGS. 3 and 4, the reciprocating nozzle assembly 40 extends inside a tube 38 of the reciprocating lid assembly 22 and comprises a number of nozzles 42. The nozzles 42 have the form of a needle. The nozzle assembly 40 comprises a needle support 41 and multiple needles 42. The nozzles are fed with liquid via feed channel 43 inside the nozzle assembly. The feed channel 43 inside the nozzle assembly is connected with the outside feed channel 36 coming from the valve via connector 45.

The reciprocating nozzle assembly 40 is constructed to make a first reciprocating movement in the direction of arrow 25 relative to the container holder 12 and relative to the reciprocating lid assembly 22 from a retracted nozzle position in which a nozzle 42 is retracted from the container to an inserted nozzle position in which the nozzle 42 is inserted into the container 11. In FIG. 3, the nozzles 42 are shown in the retracted nozzle position. In FIG. 4 the nozzles are shown in the inserted nozzle position.

Each filling assembly further comprises a reciprocating lid assembly 22 which comprises a lid member 30 (shown in FIG. 2) which is described further below. The reciprocating lid assembly is configured to make a reciprocating movement as indicated by arrow 24 relative to the associated container holder 12 in a direction towards a filling opening 26 of the container 11 which is positioned in the container holder and back in a direction away from the filling opening 26 of the container.

The reciprocating lid assembly 22 also makes a reciprocating movement relative to the associated reciprocating nozzle assembly 40. The reciprocating nozzle assembly and the reciprocating lid assembly are coaxial. The reciprocating nozzle assembly and the reciprocating lid assembly are arranged in a sliding manner and have sliding couplings 110 to enable the sliding movement.

The reciprocating lid assembly 22 is under pre-tension by a pre-tension device in the form of a spring 28 in the direction of the filling opening 26. A different kind of pre-tension device is also possible. The spring 28 urges the lid member from a retracted lid position to an extended position. When a container is present, the lid member does not reach the extended position but engages the filling opening 26 of the container 11 at a closed lid position. In the closed lid position the lid member at least partially closes the filling opening during filling.

Although in the present document the lid member is disclosed as "engaging" the opening, the skilled person will understand that this means that the lid member will generally engage the rim of the opening.

The spring urges the lid member 30 to the extended position in case there is no container present in the container position. The closed lid position lies between the retracted lid position and the extended lid position. The spring 28 holds the lid member against the filling opening. In this embodiment, the extended position is located below the closed lid position.

A feed channel 36 is provided for each filling assembly 20. A valve 34 in the feed channel 36 is coupled to an associated reciprocating lid assembly 22 via a valve coupling 32. The valve coupling 32 switches the valve to a filling position in the closed lid position and switches the valve to a return position in the extended position. In the filling position the feed channel is open. A return channel 37 extends from the valve 34 back to a reservoir. In the return position of the valve, the valve closes the feed channel 36 and opens the return channel 37 to prevent liquid from being ejected onto the empty container position 12. Instead, the liquid returns via the return channel.

The lid member 30 comprises multiple openings 44. The nozzles 42 move through these opening 44 to be inserted into the container for filling the container with a liquid.

In operation, when the cam 80 runs through the inclined section 83, the reciprocating nozzle assembly 40 and the reciprocating lid assembly 22 first move jointly, i.e. in a joint movement, toward the filling opening 26. The reciprocating nozzle assembly is moved directly by the cam 80 which moves along the curved cam track section 83. The reciprocating lid assembly is urged by the spring 28 and is allowed to move because a stop member 61 on the reciprocating nozzle assembly is moved toward the filling opening. The stop member 61 acts on a mating stop member 60 of the reciprocating lid assembly 22.

When the stop member 61 of the reciprocating nozzle assembly moves toward the filling opening, the reciprocating lid assembly 22 follows this movement. The stop members 60, 61 stay engaged during this movement. Once the lid member 30 of the reciprocating lid assembly 22 engages the filling opening 26, the reciprocating lid assembly 22 stops.

The stop members 60, 61 disengage. From this point onward, the reciprocating nozzle assembly continues to be moved by the cam 80, while the reciprocating lid assembly 22 remains stationary.

The nozzles 42 are inserted into the container 11 to the inserted nozzle position. To this end, the nozzle assembly 40 is moved further downward by the cam track 81.

Next, the container is filled by pumping liquid through a feed channel 36, through the valve 34 and onwards through the feed channel 36, through the nozzles 42 and into the container 11. The pump itself does not form part of the present invention.

After the filling of the container, the nozzle assembly 40 is retracted. This is brought about by another inclined section of the cam track 81. This inclined section is inclined upward to force an upward movement of the cam. In FIG. 1 this section is on the rear side of the body 85.

Initially, the nozzle assembly 40 moves upward while the reciprocating lid assembly 22 remains stationary and the lid member 30 remains engaged with the filling opening 26. The nozzles 42 move through the openings in the lid member.

This has the advantage that if the container is filled with non-wovens, the non-wovens may get stuck to the nozzle 42. The lid member 30 prevents the non-wovens from being pulled out of the container by the retracting nozzles 42.

When the nozzles 42 are retracted further, the stop member 61 of the nozzle assembly 40 engages the stop member 60 of the reciprocating lid assembly again. From this point onward the reciprocating nozzle assembly 40 and the reciprocating lid assembly 22 make a joint movement away from the filling opening, and the lid member 30 is disengaged from the filling opening. Basically, the reciprocating nozzle assembly 40 pulls the reciprocating lid assembly against the action of the spring 28 away from the filling opening. The retracting movement will typically be upward, although other directions are possible.

The retracting may take place during the filling. This has the advantage of a further time gain since two steps are carried out simultaneously. Moreover, this has the positive effect that the liquid is distributed over the volume of the non-wovens. Some non-wovens do not absorb liquid very well, and the distribution ensures that the complete or substantially complete volume of the non-woven is filled with liquid.

Figure 5:
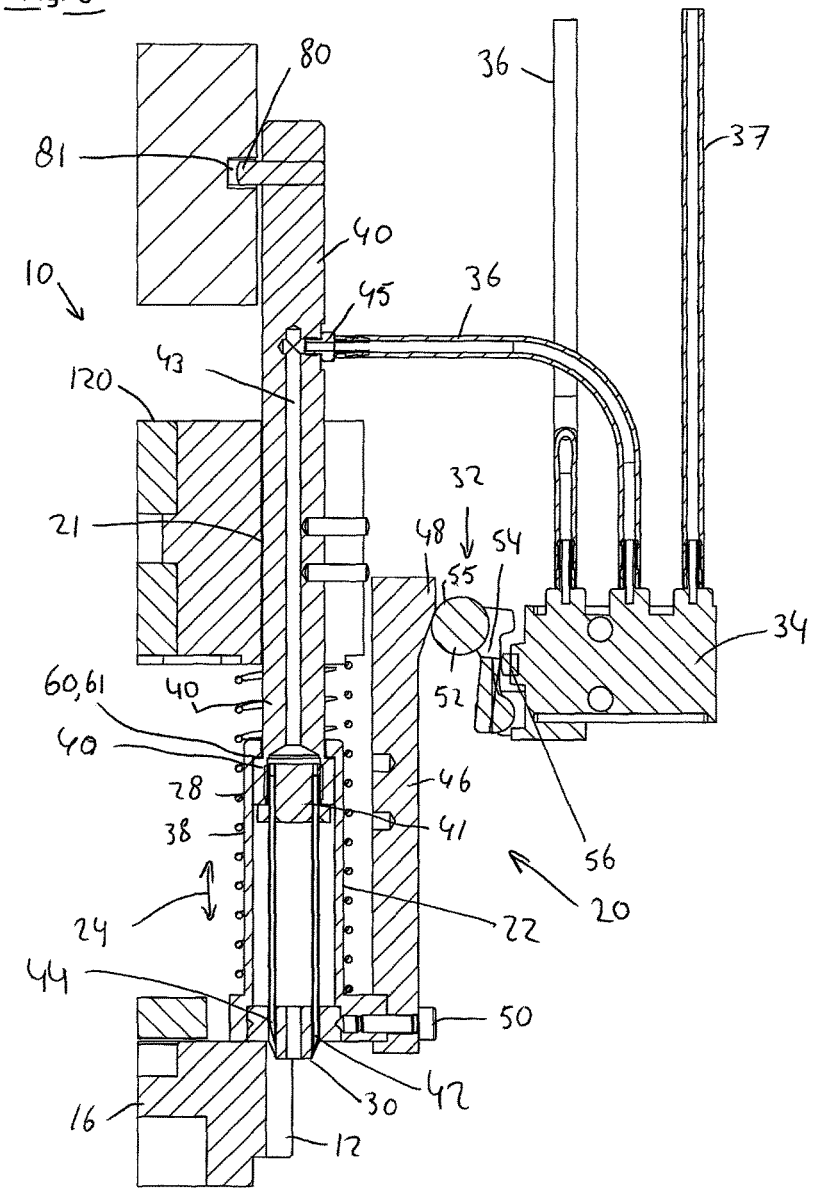
FIG. 5 shows a further sectional side view of the filling assembly in an extended position.

Turning to FIG. 5, a situation is shown in which there is no container present in the container holder 12. As a result, the lid member 30 is not stopped by a filling opening of a container and the reciprocating lid assembly 22 continues to move with the reciprocating nozzle assembly 40 to the extended position which is beyond the closed lid position. The lid member eventually engages the container holder 12 itself and stops in that extended lid position.

The valve coupling 32 between the reciprocating lid assembly 22 and the valve 34 comprises a coupling member 46 in the form of a bar having a valve cam 48. The valve cam is an enlarged portion of the coupling member 46. The valve cam reciprocates with the reciprocating lid assembly. The bar is mounted to a lower end of the reciprocating lid assembly 22 via a screw 50, but any other connection is conceivable.

The valve cam 48 engages an operating member 52 of the valve, which in this embodiment comprises a pivotable arm 54 having a round abutment surface 55. The pivotable arm 54 engages a button 56 of the valve.

When the reciprocating lid assembly moves all the way to the extended position, the cam 48 engages the abutment surface of the operating member 52. The pivotable arm 54 pivots and presses the button 56 which closes the valve of the feed channel 36. In this way, no liquid is ejected when no container 11 is present. When no container is present, the nozzles 42 stay inside the tube 38. It is noted that the nozzles 42 move downwards to the same position as when a container would be present. However, due to the lower position of the lid member 30 and the tube 38, the nozzles 4 do not protrude from the lid member.

In effect, the cam 80 with the help of the spring 28 and the stop member 60, 61 operates the reciprocating movement of the reciprocating nozzle assembly 40 and the reciprocating lid assembly 22.

The valve 34 only switches when the lid member 30 is moved to the extended position. This has an advantage that the valve is not operated unnecessarily and thereby does not wear excessively. In this way, the valve can reach a long lifespan.

In this embodiment, the reciprocating lid assembly makes a vertical reciprocating movement, and the reciprocating nozzle assembly also makes a vertical reciprocating movement. In this way, gravity helps during filling. Other orientations are of course conceivable.

In operation the following steps are carried out if a container is present in the container holder:

- moving the reciprocating nozzle assembly and the reciprocating lid assembly toward the filling opening,
- engaging the lid member 30 with the filling opening of the container in the closed lid position,
- inserting the nozzle into the container through the lid member by a further movement of the reciprocating nozzle assembly, wherein the valve stays in the filling position in which the feed channel is open,
- filling the container,
- retracting the nozzle from the container through the lid member by a retracting movement of the reciprocating nozzle assembly,
- disengaging the lid member from the container and retracting the lid member to a position to a distance from the filling opening, If no container is present the following steps are carried out:

- moving the reciprocating nozzle assembly and the reciprocating lid assembly toward the container holder to the extended position,
- engaging the container holder by the lid member, and switching the valve to close the feed channel,
- not ejecting any liquid from the nozzle,
- retracting the reciprocating nozzle assembly and the reciprocating lid assembly.

The container may comprise non-wovens or similar material for absorbing the liquid, and wherein the at least one nozzle penetrates into the non-wovens during filling of the container, and wherein the non-wovens have the tendency to stick to the nozzle during the movement of the nozzle out of the container, and wherein the lid member blocks the non-wovens from being pulled out of the container by the retracting nozzle.

The retracting and the filling step may take place simultaneously. This results in a time gain.

Further, the non-wovens may not absorb the liquid very easily. By retracting and filling at the same time the liquid is distributed over the non-wovens.

Figure 6:
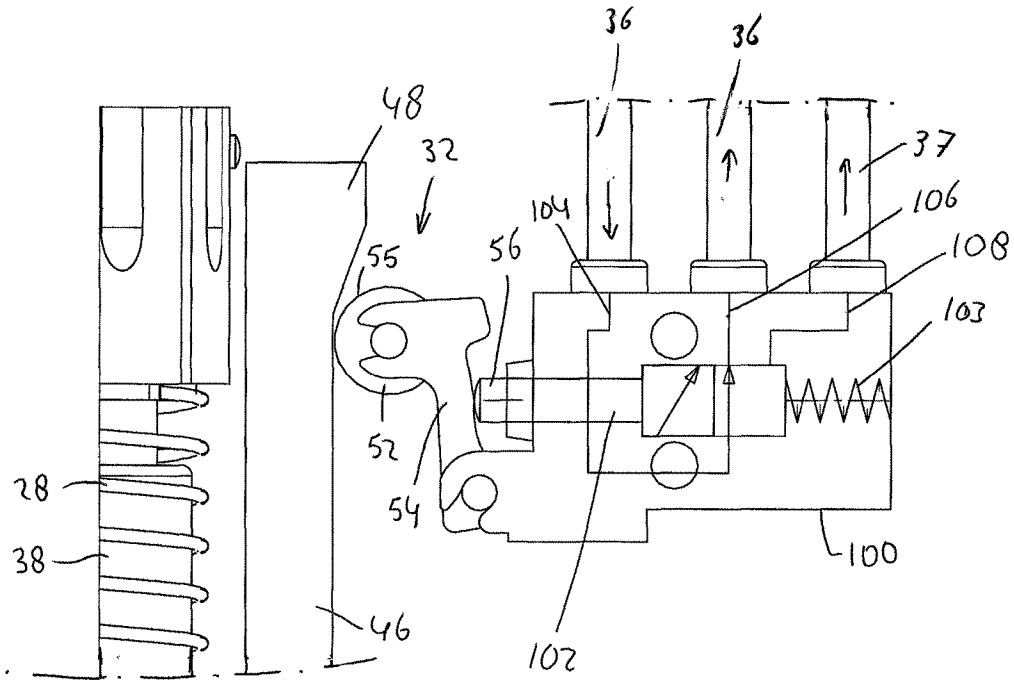
FIG. 6 shows a schematic view of a valve in a first position.
Figure 7:
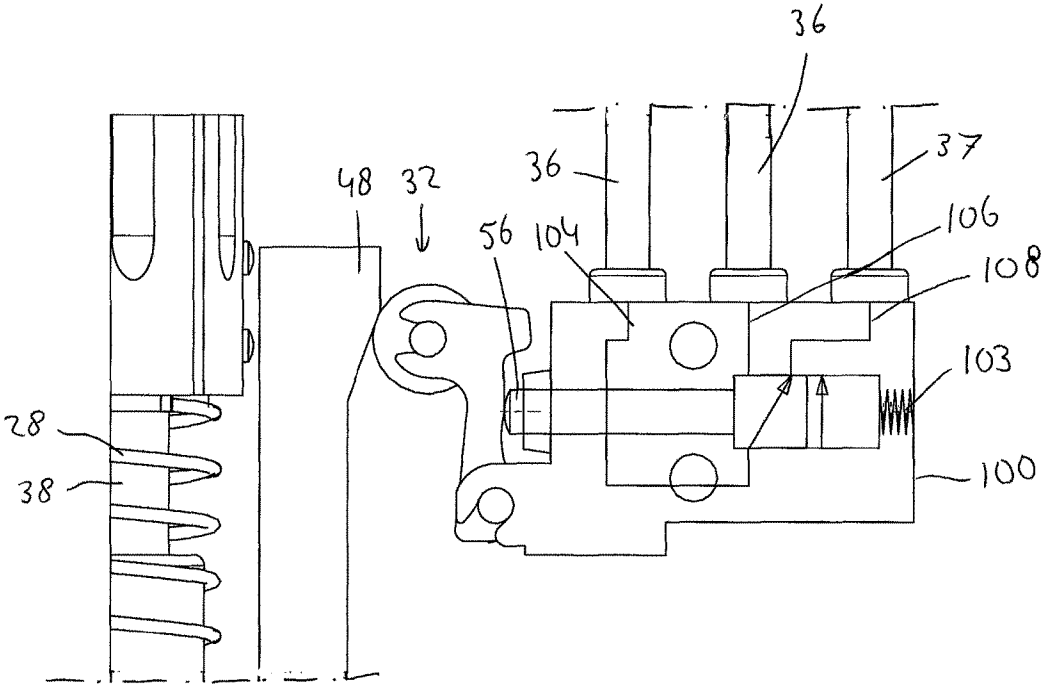
FIG. 7 shows a schematic view of a valve in a second position.

Turning to FIGS. 6 and 7, the valve 34 is shown in more detail. The valve 34 comprises a housing 100 and a movable member 102 inside the housing. The movable member is biased to the left in the figure by a compression spring 103. The housing defines an entry passage 104 for the feed channel 36 and an exit passage 106 for the feed channel. A return passage 108 is also defined for the return channel.

FIG. 6 shows the filling position and FIG. 7 shows the return position. The movable member 102 comprises the button 56 discussed above.

The filling station disclosed above provides a suitable variant to known filling stations.

It will be recognized that in an embodiment, the two reciprocating movements of the nozzle assembly and the lid assembly require only a single cam track. This results in a relatively simple system.

It will be recognized that not an embodiment may not achieve all of the stated objects.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

Clauses

1. Filling station (10) for filling containers (11) with a liquid, the filling station comprising:

a number of container holders (12) which define respective container positions (14), a number of filling assemblies (20), wherein each filling assembly is associated with a container holder, wherein each filling assembly comprises:

a reciprocating nozzle assembly (40) which is constructed to make a first reciprocating movement relative to the associated container holder from a retracted nozzle position in which a nozzle (42) is retracted from the container to an inserted nozzle position in which the nozzle is inserted into the container, wherein the nozzle moves through an opening in a lid member of a reciprocating lid assembly to be inserted into the container for filling the container with a liquid, the reciprocating lid assembly (22) comprising the lid member (30), wherein the reciprocating lid assembly is configured to make a second reciprocating movement relative to the associated container holder in a direction towards a filling opening (26) of the container (11) which is positioned in the container holder and back in a direction away from the filling opening of the container, wherein the reciprocating lid assembly is under pre-tension in the direction of the container holder (12), and wherein the lid member is urged by the pre-tension from a retracted lid position to an extended position beyond the filling opening, wherein in case a container is present in the container holder the lid member (30) engages the filling opening in a closed lid position which lies between the retracted lid position and the extended lid position, thereby at least partially closing the filling opening during filling, and wherein in case there is no container present in the container holder the lid member (30) is urged to the extended position, wherein the reciprocating lid assembly is coupled via a valve coupling (32) to an associated valve (34) in a feed channel (36) which valve opens the feed channel in the closed lid position and closes the feed channel in the extended position.

2. Filling station according to clause 1, wherein during the movement toward the filling opening the reciprocating lid assembly (22) and the reciprocating nozzle assembly (40) first move jointly until the lid member of the reciprocating lid assembly engages the filling opening in the closed lid position, and wherein from this moment onward, the reciprocating lid assembly is stationary relative to the filling opening while the reciprocating nozzle assembly continues to move, thereby inserting the nozzle into the container, and wherein after the filling of the container the reciprocating nozzle assembly is retracted to an engagement position, wherein in the engagement position a stop member (61) of the reciprocating nozzle assembly engages a stop member (60) of the reciprocating lid assembly, and wherein from this point onward the reciprocating lid assembly (22) is retracted by the reciprocating nozzle assembly (40) against the biasing action via the engaging stop members.

3. Filling station according to any of the preceding clauses, wherein the biasing action is caused by a spring.

4. Filling station according to any of the preceding clauses, wherein the reciprocating nozzle assembly is driven by a cam (80) in a cam track (81).

5. Filling station according to any of the preceding clauses, wherein the reciprocating lid assembly is not driven by a cam directly, but only by the biasing action, in particular of the spring, and by the reciprocating nozzle assembly.

6. Filling station according to any of the preceding clauses, wherein the reciprocating nozzle assembly and the biasing device jointly operate the second reciprocating movement of the reciprocating lid assembly.

7. Filling station according to any of the preceding clauses, wherein in the retracted position the reciprocating nozzle assembly holds the reciprocating lid assembly against the biasing action.

8. Filling station (10) according any of the preceding clauses, wherein the lid member (30) of the reciprocating lid assembly is initially moved to the closed lid position, and wherein subsequently the nozzle (42) is inserted into the container to the inserted nozzle position, wherein subsequently filling takes place, and wherein subsequently the nozzle is retracted from the container and wherein subsequently the reciprocating lid assembly (40) is moved away from the container, thereby disengaging the lid member from the filing opening.

9. Filling station (10) according to any of the preceding clauses, wherein the valve coupling (32) between the reciprocating lid assembly (40) and the valve (34) comprises a valve cam (48) which reciprocates with the reciprocating lid assembly, wherein the valve cam engages an operating member (52) of the valve.

10. Filling station (10) according to any of the preceding clauses, wherein the lid member comprises multiple openings (44) and the nozzle assembly comprises multiple nozzles (42) which move through said openings.

11. Filling station (10) according to any of the preceding clauses, wherein the nozzle is retracted inside a tube (38) of the reciprocating lid assembly.

12. Filling station (10) according to the preceding clause, wherein the spring extends around said tube (38).

13. Filling station (10) according to any of the preceding clauses, wherein the multiple container holders (12) and associated filling assemblies (20) are mounted on a rotary frame to form a carousel which makes a rotary movement, wherein the multiple container holders are arranged in a circle for rotary movement, and wherein the multiple filling assemblies are also arranged in a circle, and wherein the filling station comprises a nozzle assembly cam track (81), and wherein each reciprocating nozzle assembly comprises a nozzle assembly cam (80) which runs through the nozzle assembly cam track, and wherein the nozzle assembly cam track comprises a cam track closing section (83) which is configured to allow the spring to move the reciprocating lid assembly to a closed lid position, and wherein the cam track comprises a retracting section configured to retract the lid member from the filling opening of the container.

14. Filling station (10) according to any of the preceding clauses, wherein the reciprocating nozzle assembly and the reciprocating lid assembly are coaxial.

15. Filling station (10) according to any of the preceding clauses, wherein the reciprocating lid assembly (22) makes a reciprocating movement relative to the associated reciprocating nozzle assembly (40).

16. Filling station (10) according to any of the preceding clauses, wherein the reciprocating nozzle assembly and the reciprocating lid assembly slide relative to one another.

17. Filling station (10) according to any of the preceding clauses, wherein a substantial part of the reciprocating nozzle is located inside a tube of the reciprocating lid assembly.

18. Filling station (10) according to any of the preceding clauses, wherein a cam (80) of the reciprocating nozzle extend to a position above the reciprocating lid assembly.

19. Filling station (10) according to any of the preceding clauses, comprising a filling assembly support frame (18) which comprises a number of nozzle assembly guides which guide the associated reciprocating nozzle assembly.

20. Filling station according to any of the preceding clauses, wherein the nozzle comprises one or more needles (42) which extend through the one or more openings in the lid member (30).

21. Filling station according to any of the preceding clauses, wherein the reciprocating lid assembly makes a vertical reciprocating movement, and wherein the reciprocating nozzle assembly also makes a vertical reciprocating movement.

22. Method of filling containers (11) with a liquid, the method comprising providing the filling station (10) according to clause 1, and carrying out either process a) or process b), process a) comprising:

positioning a container (11) in a container holder, moving the reciprocating nozzle assembly and the reciprocating lid assembly toward the filling opening, engaging the lid member (30) with the filling opening of the container in the closed lid position, inserting the nozzle into the container through the lid member by a further movement of the reciprocating nozzle assembly, wherein the valve (34) stays in the filling position in which the feed channel is open, filling the container, retracting the nozzle from the container through the lid member by a retracting movement of the reciprocating nozzle assembly, disengaging the lid member from the container and retracting the lid member to a position to a distance from the filling opening, process b) comprising:

not positioning a container (11) in a container holder, moving the reciprocating nozzle assembly and the reciprocating lid assembly toward the container holder to the extended position, engaging the container holder (12) by the lid member (30), and switching the valve (34) to close the feed channel, not ejecting any liquid from the nozzle, retracting the reciprocating nozzle assembly and the reciprocating lid assembly.

23. Method according to the preceding method clause, wherein the container comprises non-wovens or similar material for absorbing the liquid, and wherein the at least one nozzle penetrates into the non-wovens during filling of the container, and wherein the non-wovens have the tendency to stick to the nozzle during the movement of the nozzle out of the container, and wherein the lid member blocks the non-wovens from being pulled out of the container by the retracting nozzle.

The invention claimed is:

1. A filling station for filling containers with a liquid, the filling station comprising:

a number of container holders which define respective container positions, a number of filling assemblies, wherein each filling assembly is associated with a container holder, wherein each filling assembly comprises:

a reciprocating nozzle assembly which is constructed to make a first reciprocating movement relative to the associated container holder from a retracted nozzle position in which a nozzle is retracted from the container to an inserted nozzle position in which the nozzle is inserted into the container, wherein the nozzle moves through an opening in a lid member of a reciprocating lid assembly to be inserted into the container for filling the container with a liquid, and the reciprocating lid assembly comprising the lid member, wherein the reciprocating lid assembly is configured to make a second reciprocating movement relative to the associated container holder in a direction towards a filling opening of the container which is positioned in the container holder and back in a direction away from the filling opening of the container, wherein the reciprocating lid assembly is under pre-tension in the direction of the container holder, and wherein the lid member is urged by the pre-tension from a retracted lid position to an extended position beyond the filling opening, wherein in case a container is present in the container holder the lid member engages the filling opening in a closed lid position which lies between the retracted lid position and the extended lid position, thereby at least partially closing the filling opening during filling, and wherein in case there is no container present in the container holder the lid member is urged to the extended position, wherein the reciprocating lid assembly is coupled via a valve coupling to an associated valve in a feed channel, wherein the associated valve opens the feed channel in the closed lid position and closes the feed channel in the extended position.

2. The filling station according to claim 1, wherein during the movement toward the filling opening the reciprocating lid assembly and the reciprocating nozzle assembly first move jointly until the lid member of the reciprocating lid assembly engages the filling opening in the closed lid position, and wherein from this moment onward, the reciprocating lid assembly is stationary relative to the filling opening while the reciprocating nozzle assembly continues to move, thereby inserting the nozzle into the container, and wherein after the filling of the container the reciprocating nozzle assembly is retracted to an engagement position, wherein in the engagement position a stop member of the reciprocating nozzle assembly engages a stop member of the reciprocating lid assembly, and wherein from this point onward the reciprocating lid assembly is retracted by the reciprocating nozzle assembly against a biasing action via the engaging stop members.

3. The filling station according to claim 2, wherein the biasing action is caused by a spring.

4. The filling station according to claim 3, wherein the reciprocating lid assembly is not driven by a cam directly, but only by the biasing action of the spring and by the reciprocating nozzle assembly.

5. The filling station according to claim 1, wherein the reciprocating nozzle assembly is driven by a cam in a cam track.

6. The filling station according to claim 1, wherein the reciprocating nozzle assembly and a biasing device jointly operate the second reciprocating movement of the reciprocating lid assembly.

7. The filling station according to claim 1, wherein in the retracted position the reciprocating nozzle assembly holds the reciprocating lid assembly against a biasing action.

8. The filling station according to claim 1, wherein the lid member of the reciprocating lid assembly is initially moved to the closed lid position, and wherein subsequently the nozzle is inserted into the container to the inserted nozzle position, wherein subsequently filling takes place, and wherein subsequently the nozzle is retracted from the container and wherein subsequently the reciprocating lid assembly is moved away from the container, thereby disengaging the lid member from the filing opening.

9. The filling station according to claim 1, wherein the valve coupling between the reciprocating lid assembly and the valve comprises a valve cam which reciprocates with the reciprocating lid assembly, wherein the valve cam engages an operating member of the valve.

10. The filling station according to claim 1, wherein the lid member comprises multiple openings and the nozzle assembly comprises multiple nozzles which move through said openings.

11. The filling station according to claim 1, wherein the nozzle is retracted inside a tube of the reciprocating lid assembly.

12. The filling station according to claim 11, wherein a spring extends around said tube.

13. The filling station according to claim 1, wherein the multiple container holders and associated filling assemblies are mounted on a rotary frame to form a carrousel which makes a rotary movement, wherein the multiple container holders are arranged in a circle for rotary movement, and wherein the multiple filling assemblies are also arranged in a circle, and wherein the filling station comprises a nozzle assembly cam track, and wherein each reciprocating nozzle assembly comprises a nozzle assembly cam which runs through the nozzle assembly cam track, and wherein the nozzle assembly cam track comprises a cam track closing section which is configured to allow the spring to move the reciprocating lid assembly to a closed lid position, and wherein the cam track comprises a retracting section configured to retract the lid member from the filling opening of the container.

14. The filling station according to claim 1, wherein the reciprocating lid assembly makes a reciprocating movement relative to the associated reciprocating nozzle assembly.

15. The filling station according to claim 1, wherein a substantial part of the reciprocating nozzle assembly is located inside a tube of the reciprocating lid assembly.

16. The filling station according to claim 1, wherein a cam of the reciprocating nozzle assembly extend to a position above the reciprocating lid assembly.

17. The filling station according to claim 1, comprising a filling assembly support frame which comprises a number of nozzle assembly guides which guide the associated reciprocating nozzle assembly.

18. The filling station according to claim 1, wherein the nozzle comprises one or more needles which extend through the one or more openings in the lid member.

19. A method of filling containers with a liquid, the method comprising providing the filling station according to claim 1, and carrying out either process a) or process b), process a) comprising:

positioning a container in a container holder, moving the reciprocating nozzle assembly and the reciprocating lid assembly toward the filling opening, engaging the lid member with the filling opening of the container in the closed lid position, inserting the nozzle into the container through the lid member by a further movement of the reciprocating nozzle assembly, wherein the valve stays in the filling position in which the feed channel is open, filling the container, retracting the nozzle from the container through the lid member by a retracting movement of the reciprocating nozzle assembly, and disengaging the lid member from the container and retracting the lid member to a position to a distance from the filling opening, process b) comprising:

not positioning a container in a container holder, moving the reciprocating nozzle assembly and the reciprocating lid assembly toward the container holder to the extended position, engaging the container holder by the lid member, and switching the valve to close the feed channel, not ejecting any liquid from the nozzle, and retracting the reciprocating nozzle assembly and the reciprocating lid assembly.

20. The method according to claim 19, wherein the container comprises non-wovens or similar material for absorbing the liquid, and wherein the at least one nozzle penetrates into the non-wovens during filling of the container, and wherein the non-wovens have the tendency to stick to the nozzle during the movement of the nozzle out of the container, and wherein the lid member blocks the non-wovens from being pulled out of the container by the retracting nozzle.

* * * * *